US010051720B1

(12) United States Patent
Shurter et al.

(10) Patent No.: US 10,051,720 B1
(45) Date of Patent: Aug. 14, 2018

(54) RADIO FREQUENCY FIELD IMMERSED ULTRA-LOW TEMPERATURE ELECTRON SOURCE

(71) Applicant: Los Alamos National Security, LLC, Los Alamos, NM (US)

(72) Inventors: Roger Shurter, Los Alamos, NM (US); Jose Taccetti, Santa Fe, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 83 days.

(21) Appl. No.: 15/205,981

(22) Filed: Jul. 8, 2016

Related U.S. Application Data

(60) Provisional application No. 62/190,143, filed on Jul. 8, 2015.

(51) Int. Cl.
*H05H 7/20* (2006.01)

(52) U.S. Cl.
CPC ..... *H05H 7/20* (2013.01)

(58) Field of Classification Search
None
See application file for complete search history.

(56) References Cited

U.S. PATENT DOCUMENTS 5,583,393 A 12/1996 Denz et al.
5,825,847 A * 10/1998 Ruth ..... G03F 7/70025 378/119
6,400,091 B1 6/2002 Deguchi et al.
6,538,368 B1 3/2003 Fox et al.
6,650,061 B1 11/2003 Urayama et al.
7,455,754 B2 11/2008 Wesner et al.
7,786,675 B2 * 8/2010 Yakovlev ..... H05H 7/22 315/5.39
8,075,360 B2 12/2011 Teramoto et al.
8,159,158 B2 * 4/2012 Popovic ..... H05H 7/18 315/500
8,227,985 B2 * 7/2012 Shurter ..... H01J 1/304 313/103 R
8,674,630 B1 * 3/2014 Cornelius ..... H05H 7/20 315/5.41

(Continued)

OTHER PUBLICATIONS

CERN publication "SRF" Aug. 2013 web publication.*

(Continued)

*Primary Examiner* — Douglas W Owens
*Assistant Examiner* — Srinivas Sathiraju
(74) *Attorney, Agent, or Firm* — Klarquist Sparkman, LLP

(57) ABSTRACT

Disclosed below are representative embodiments of methods, apparatus, and systems for generating electrons. For example, certain embodiments comprise a charge gating diamond QED based electron source, which can be suspended within the RF cavity of an electron injection system in a superconducting radiofrequency (SRF) electron accelerator. Embodiments of the disclosed technology are capable of producing low temperature (cold) electron beams, where "temperature" refers to the transverse energy in the extracted electron beam (or beam emittance). Embodiments of the disclosed technology can also exhibit enhanced charge replenishment capabilities by virtue of the material selected to suspend the electron source within the RF cavity of the electron injection system.

14 Claims, 3 Drawing Sheets

(56) References Cited

U.S. PATENT DOCUMENTS

| | | | | |
|---|---|---|---|---|
| 8,922,107 | B2 * | 12/2014 | Rao | H01J 3/021 313/387 |
| 9,196,449 | B1 * | 11/2015 | Chang | H01J 23/06 |
| 9,386,682 | B2 * | 7/2016 | Tantawi | H01P 1/207 |
| 9,728,931 | B2 * | 8/2017 | Nikipelov | H01S 3/0903 |
| 2004/0108823 | A1 * | 6/2004 | Amaldi | H05H 7/22 315/505 |
| 2005/0092929 | A1 | 5/2005 | Schneiker | |
| 2006/0001360 | A1 | 1/2006 | Tatsumi et al. | |
| 2006/0033417 | A1 | 2/2006 | Srinivasan-Rao et al. | |
| 2006/0087248 | A1 | 4/2006 | Konishi et al. | |
| 2006/0113891 | A1 | 6/2006 | Nishimura et al. | |
| 2006/0175953 | A1 | 8/2006 | Swain et al. | |
| 2007/0205710 | A1 | 9/2007 | Sagawa et al. | |
| 2007/0216284 | A1 | 9/2007 | Takegami | |
| 2007/0252507 | A1 | 11/2007 | Jeong | |
| 2008/0174229 | A1 | 7/2008 | Jeong | |
| 2008/0278062 | A1 | 11/2008 | Moon et al. | |
| 2009/0021136 | A1 | 1/2009 | Coll et al. | |
| 2009/0078851 | A1 | 3/2009 | Watanabe et al. | |
| 2009/0191367 | A1 | 7/2009 | Chen | |
| 2009/0310333 | A1 | 12/2009 | Lee et al. | |
| 2012/0032576 | A1 * | 2/2012 | Shurter | H01J 1/304 313/310 |
| 2017/0094770 | A1 * | 3/2017 | Kephart | H05H 7/22 |

OTHER PUBLICATIONS

D Jansen et al "Emittance compensation in a superconducting RF photoelectron gun by a magnetic field" p. 330-332 Proceedings of EPAC 2004 Switzerland.*

Xiang et al "Electron sources and polarization" Proceedings of eeFACT 2016. p. 94-99.*

Glatkowski, "Carbon Nanotube Based Transparent Conductive Coatings," *48th Int'l SAMPE Symp.*, 7 pp. (2003).

McEuen, "Single-wall carbon nanotubes," *Physics World*, pp. 31-36 (Jun. 2000).

* cited by examiner

300

RADIO FREQUENCY FIELD IMMERSED ULTRA-LOW TEMPERATURE ELECTRON SOURCE

CROSS-REFERENCE TO RELATED APPLICATIONS

This application claims the benefit of U.S. Provisional Application No. 62/190,143 entitled "RADIO FREQUENCY FIELD IMMERSED ULTRA-LOW TEMPERATURE ELECTRON SOURCE" and filed on Jul. 8, 2015, which is hereby incorporated herein by reference in its entirety.

ACKNOWLEDGEMENT OF GOVERNMENT SUPPORT

This invention was made with government support under Contract No. DE-AC52-06NA25396 awarded by the U.S. Department of Energy. The government has certain rights in the invention.

FIELD

This application relates to the field of electron beam generation as can be used in accelerators.

SUMMARY

Disclosed below are representative embodiments of methods, apparatus, and systems for generating electrons. For example, certain embodiments comprise a charge gating diamond QED based electron source, which can be suspended within the RF cavity of an electron injection system in a superconducting radiofrequency (SRF) electron accelerator. Embodiments of the disclosed technology are capable of producing low temperature (cold) electron beams, where "temperature" refers to the transverse energy in the extracted electron beam (or beam emittance). Embodiments of the disclosed technology can also exhibit enhanced charge replenishment capabilities by virtue of the material selected to suspend the electron source within the RF cavity of the electron injection system.

In some embodiments, an electron injection system for a superconducting radiofrequency (SRF) accelerator system is disclosed. In such embodiments, the system comprises a liquid-cooled vessel defining a radio frequency (RF) cavity in which an electron source is located; and an electron source located within the RF cavity, but not in direct contact with any surface of the RF cavity. In particular implementations, the electron source is suspended within the RF cavity such that a back plane of the electron source does not make any direct contact with a back wall of the RF cavity. In some implementations, the system further comprises one or more support structures that extend from a back wall of the RF cavity and mechanically connect with a back plane of the electron source. In such implementations, the system can further comprise one or more light guides surrounding respective ones of the support structures, the one or more light guides also extending from the back wall of the RF cavity. In some implementations, the support structures comprise one or more boron filaments. More generally, the support structures can comprise one or more filaments having variable semiconductivity. In some implementations, the system further comprises one or more light guides configured to transmit photons from a photon source external the RF cavity to a back plane of the electron source, thus causing electron emission from the electron source. The photon source can be, for instance, a UV laser source or a soft x-ray source. Still further, the photon source can be further configured to transmit photons through the light guides at a time during which a periodic electric field in the RF cavity causes electron beam emission from a front surface of the electron source opposite of the back plane of the electron source. In some example embodiments, the electron source comprises a diamond structure (e.g., a diamond QED based electron source). For instance, the diamond QED based electron source can further comprise: a carbon nanotube structure adjacent to which a diamond structure is located; and a platinum coating at an end of the carbon nanotube structure. In some example embodiments, the liquid-cooled vessel contains a volume of liquid helium.

In certain embodiments, methods are disclosed herein comprising suspending an electron source within an injector cavity of a superconducting radiofrequency (SRF) accelerator system such that the electron source is located within an RF cavity, but not in direct contact with any surface of the RF cavity. In some implementations, the method further comprises selectively transmitting photons to a back plane of the electron source at times synchronized with the periodic RF field generated in the RF cavity, the photons being generated from a light source external to the RF cavity. For instance, in some examples, the selectively transmitting photons is performed by transmitting photons toward the back plane of the electron source through one or more light guides that have respective transmission ends that are located at the back wall of the RF cavity or extend into the RF cavity. Further, in certain examples, the suspending is performed by one or more support structures having selective semiconductivity, and the method further comprises selectively adjusting the semiconductivity of the support structure in order to alter the electronic replenishment within the RF cavity.

In further example embodiments disclosed herein, a superconducting radiofrequency (SRF) accelerator system is disclosed comprising: a liquid-cooled vessel defining a radio frequency (RF) cavity in which an electron source is located; and a photon-activated electron source located within the RF cavity, the photon-activated electron source being suspended in an interior of the RF cavity distal from an end wall of the RF cavity. In some example implementations, the photon-activated electron source is suspended within the RF cavity by one or more support structures comprising one or more filaments having variable semiconductivity (e.g., Boron). In certain example implementations, the electron source comprises a diamond QED based electron source.

The foregoing and other objects, features, and advantages of the invention will become more apparent from the following detailed description, which proceeds with reference to the accompanying figures.

DETAILED DESCRIPTION

I. General Considerations

Figure 1:
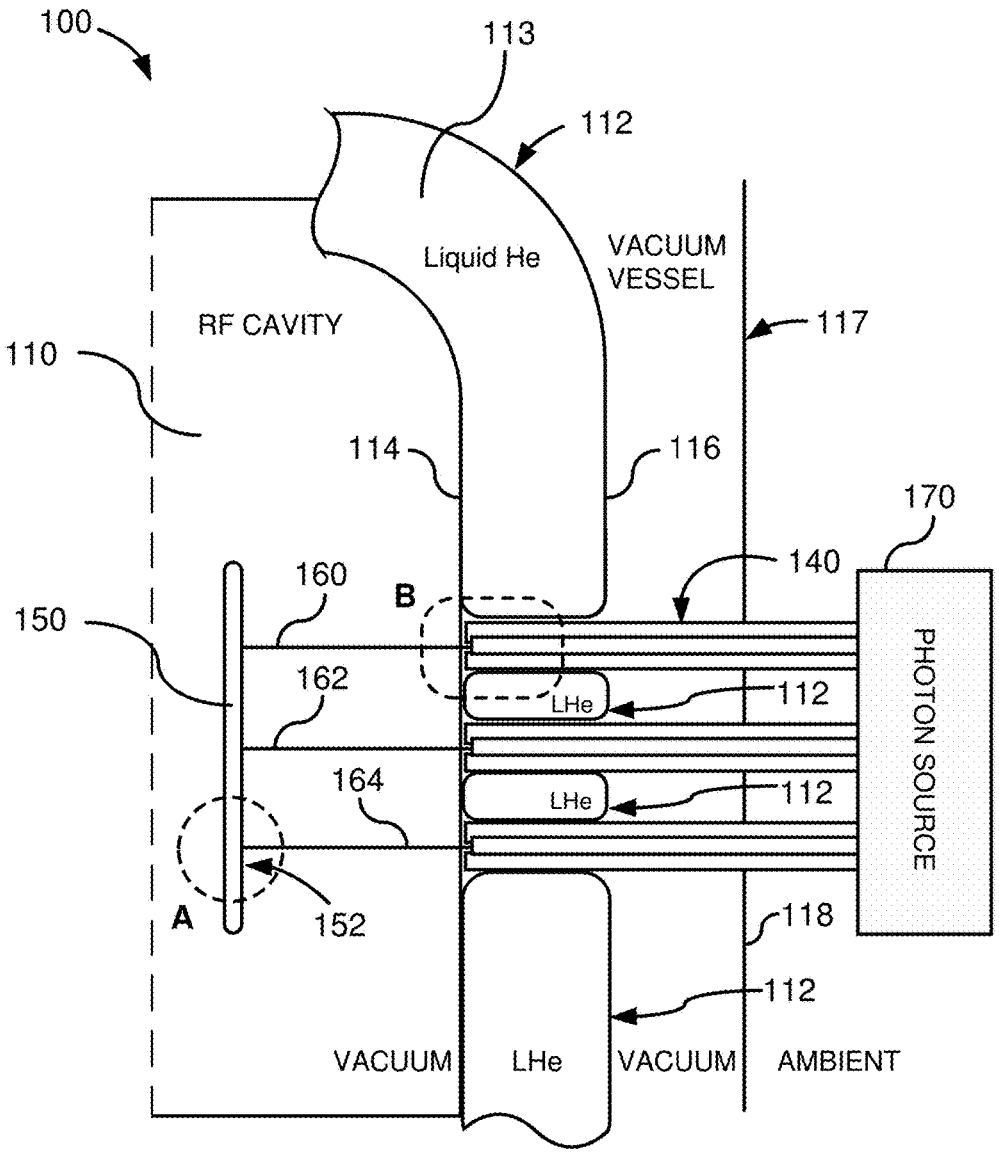
FIG. 1 is a schematic block diagram that illustrates an example embodiment of an electron source suspended within an RF cavity in accordance with the disclosed technology.

Disclosed below are representative embodiments of methods, apparatus, and systems for generating electrons and electron beams as may be used in an accelerator. The disclosed methods, apparatus, and systems should not be construed as limiting in any way. Instead, the present disclosure is directed toward all novel and nonobvious features and aspects of the various disclosed embodiments, alone or in various combinations and subcombinations with one another. Furthermore, any features or aspects of the disclosed embodiments can be used in various combinations and subcombinations with one another. For example, one or more method acts from one embodiment can be used with one or more method acts from another embodiment and vice versa. The disclosed methods, apparatus, and systems are not limited to any specific aspect or feature or combination thereof, nor do the disclosed embodiments require that any one or more specific advantages be present or problems be solved.

For the sake of simplicity, the attached figures may not show the various ways in which the disclosed methods, apparatus, and systems can be used in conjunction with other methods, apparatus, and systems. Additionally, as used herein, the term "and/or" means any one item or combination of any items in the phrase.

II. Detailed Description of Embodiments of the Disclosed Technology

Superconducting radiofrequency (SRF) electron accelerators are now in use throughout the world with several others in the planning phase. Concurrently, there is a technological push toward higher free electron laser (FEL) photon energies well into the hard x-ray region (e.g., >40 KeV XFELs). As a consequence, the requirements for SRF electron accelerator FEL drivers have become very difficult and demanding. Conventional approaches cannot meet these requirements. Embodiments of the disclosed technology address this technological deficit and, in particular implementations, use quantum electrodynamics (QED) based device(s), such as diamond QED based electron sources (cathodes) that operate using charge gating. Embodiments of the disclosed technology can be used to provide electron multi-nanocoulomb bunched charge injection in the MHz-GHz frequency range.

Embodiments of the disclosed technology help address several problems with conventional electron injection systems. For example, in conventional designs, electron sources (cathodes) are all a part of the cavity wall or some other re-entrant part of the cavity structure that is on one surface, the vacuum accelerating cavity, and on the opposite surface, the cryogenic (LHe) volume. Due to the electron emission process, there is heat generated that is conducted or radiated from the electron emitter and its surroundings. The higher the individual bunch charge and system frequency, the greater the localized heating of the cavity wall. The heat generated potentially creates quench zones where, at a critical threshold, the superconductivity of the cavity wall suddenly becomes normally conducting, thereby raising the cavity wall shunt impedance by a factor of 100 or more and causing the immediate overload and shutdown of the RF drive system.

To overcome these roadblocks for FEL accelerator drive systems, embodiments of the disclosed technology use a highly RF field transparent charge gating diamond QED based electron device as the cathode in the electron injection system and in place of the standard cathode technology. Further, in particular example implementations, the QED based device is suspended within the injector cavity and isolated from the cavity wall. With this advantageous configuration, the heat generated by the emission process is efficiently and uniformly dispersed throughout the QED based electron device (diamond has 5 times the thermal conductivity of copper). In such implementations, the heat produced in the emission process is then uniformly radiated in $4\pi$, impinging over a very large area of the accelerator injector inner cell wall (much larger than in conventional systems) with little or no localized thermal impact. This helps ensure that there are no quench zones, even at very high bunch charge and frequency.

Another feature exhibited by embodiments of the disclosed technology is that the emitted electrons transition near the device's surface from the conduction band minimum to the vacuum level without a step-up in electron energy. This is due to the n-type diamond surface layer and a negative electron affinity (NEA) surface where "cold" electrons at the conduction band minimum can tunnel directly into the vacuum level. This free charge is photo-gated at the device back surface at selected points (e.g., at or near the top of the sine wave or at another selected optimum point) in the rising RF TM010 cavity mode axial electric accelerating field, which to a significant extent penetrates the entire device surface structure. The photo-gating can be performed by selectively transmitting high-frequency (e.g., UV) laser or soft x-ray pulses to the phototransparant back plane of the electron source at the selected points of the RF field in the SRF electron injector cavity. This emission process ensures the emitted electron temperature, and therefore beam emittance, is very low (e.g., the lowest that is possibly achievable).

Yet another feature exhibited by embodiments of the disclosed technology is that the diamond QED based devices in the disclosed embodiments are far more reliable than the existing cathode technology, which is primarily alkali metal based. Still further, embodiments of the disclosed technology are air stable. The air stability and lack of reactivity to vacuum contaminants is advantageous in several ways, including: initial handling and system startup, unanticipated vacuum problems, and device production and transport methods. Reliability and lifetime are primary considerations for the funding and operation of electron injector systems, making embodiments of the disclosed technology well suited for such systems.

In certain embodiments of the disclosed technology, the electron injector systems use any of the electron sources disclosed in U.S. Pat. No. 8,227,985, entitled "PHOTO-STIMULATED LOW ELECTRON TEMPERATURE HIGH CURRENT DIAMOND FILM FIELD EMISSION CATHODE" and filed on Aug. 5, 2011, which is hereby incorporated herein by reference in its entirety.

Particular embodiments comprise, for example, an electron source comprising a combination of carbon allotropes, nanocrystalline diamond, and carbon nanotubes in combination with an atomic layer deposition of platinum at angstrom scale thicknesses at the back contact, as described for example in U.S. Pat. No. 8,227,985. The electronic properties, along with the robust nature and thermal stability, of the combination of these materials allows for the fabrication of a partially photo transparent back surface. This makes possible photo-gated electron emitters weighing only several grams for a typical application. The resonant quantum electronic structures of the disclosed technology are also useful for efficient UV or soft x-ray photon scattering through the nanocrystalline diamond bulk that provides uniform Coulomb process charge gating at the emitter surface. The photon transport through the crystalline diamond structure also creates free charge at defect sites for the replenishment of the device near surface charge and enhances electron mobility internal to the diamond bulk material.

Particular examples of the disclosed technology comprise a charge gating device within an SRF electron injector cavity. The charge gating device can be, for instance, any of the electron sources described in U.S. Pat. No. 8,227,985. The electron source can be sized for the particular SRF electron injector cavity in which it is used. For instance, the electron source can be a few millimeters in thickness (e.g., 0.5-5 mm), can weigh several grams (e.g., 1-100 grams), and/or can have a height and width sized for the cavity in which it is used (e.g., a height and width of 1 to 3 cm for most applications).

In particular example embodiments, the electron source is suspended within the cavity. The electron source can be suspended (in a manner that displaces the source away from the cavity wall) using a variety of arrangements. In certain example implementations, the electron source is suspended by an array (e.g., a periodic array) of millimeter scale diameter semiconducting boron filaments that support the device (electron source) away from the cavity back wall (e.g., at a distance of ~1-3 cm or greater depending on the cavity design, from the cavity back wall). The boron filaments can be interspersed with millimeter scale thin-walled metal light guide tubes in a zero field region in the cavity vacuum volume and also bridge the LHe volume of the cavity. The tubule light guides can be configured for gating (propagating) laser (e.g., lasers of any suitable wavelength, such as UV, EUV, or other appropriate wavelength), or soft x-ray pulses to the back plane of the electron source. Further, in particular embodiments, the light guides can cross the liquid helium (LHe) volume and thermal radiation shield of the SRF electron injector cavity and, in some cases, terminate in the wall of the outer vacuum enclosure/room air interface (or terminate after extending beyond the wall). Photonic crystal fiber optics or soft x-ray Fresnel optics can then interface with the light guides at the room air interface. The boron filament supports/electric feeds can also terminate in the external insulating vacuum volume/room air interface.

FIG. 1 is a schematic block diagram 100 that illustrates an example embodiment of the disclosed technology. In particular, FIG. 1 shows a cross-sectional view of a portion of an SRF electron injector cavity 110 in which an electron source 150 (e.g., an electron source according to any embodiment disclosed in U.S. Pat. No. 8,227,985) is suspended. The SRF electron injector cavity 110 is surrounded along its back side by a LHe shell (or vessel) 112 in which a liquid helium (LHe) volume 113 is contained. The example LHe shell/vessel 112 is formed by two metallic walls: a first wall forming a cavity back side wall 114 (or LHe shell interior wall 114) and a second wall forming a LHe shell exterior wall 116. The walls of the LHe shell/vessel 112 can be formed, for example, by niobium. The LHe shell/vessel 112 can include passages (e.g., walled apertures) through which boron filaments and/or light guides can pass. The LHe shell/vessel 112 can serve as a thermal radiation shield for the SRF electron injector cavity. The LHe shell/vessel 112 is itself contained within a vacuum vessel 117 (e.g., made of stainless steel) that includes at least one vacuum vessel wall 118 that separates the vacuum interior of the vacuum vessel 117 and the ambient air exterior. In the illustrated example embodiment, the back plane 152 of the electron source 150 is affixed to the ends of boron filaments 160, 162, 164. The boron filaments 160, 162, 164 are configured to attach to and suspend the electron source 150 away from (distal from) the cavity back side wall 114 (e.g., by 1 or more centimeters). The boron filaments can be surrounded longitudinally by an insulative sleeve or sheath (shown in FIG. 2B). In the illustrated embodiment, three boron filaments 160, 162, 164 are shown, but this number and arrangement can vary from embodiment to embodiment.

FIG. 1 also shows a set 140 of light guides (or light tubes) surrounding a respective one of the boron filaments. The light guides (e.g., the set 140 of light guides) can be configured for any suitable light source used to stimulate electron beam generation by the electron source 150 (e.g., by transmitting UV or longer wavelength laser or soft x-ray pulses to the back plane 152 of the electron source 150). For instance, the electron beam can be created by generating free charges (free electrons) at the ultrananocrystalline surface of the electron source through photostimulation by laser or x-ray sources transmitted through the light guides; this photostimulation can be timed (or synchronized) with the appropriate part of the RF sine wave in the RF cavity (e.g., at or near the top of the RF sine wave) so that the desired electron beam is generated. The point of the RF sine wave at which photostimulation is triggered may vary depending on the cavity and is desirably tuned to get as close to mono-energenic charge extraction as possible.

The light guides can be, for example, ceramic (or glass) light guides configured to transmit UV or soft x-ray photons to (or toward) the back plane 152 of the electron source 150. The light guides can also be, for example, aluminum tubes for UV light, photonic fibers, plain clad fibers terminated with (GRIN) graded index lenses in the vacuum volume for light 400 nm and above, or, in the case of soft x-rays, highly polished inside diameter stainless tubes for grazing incidence soft x-ray conduction with tube diameters suited for the particular soft x-ray photon energy. The number and/or arrangement of light guides around a boron filament can vary from embodiment to embodiment. Furthermore, the light guides do not necessarily surround a boron filament and can instead be located separate from the boron filament and directed toward the back plane 152 of the electron source 150. Additionally, and as shown in FIGS. 1 and 2B, the light guides can terminate at the interface of the RF cavity 110 and the cavity back side wall 114. This configuration, however, should not be construed as limiting, as the light guides can extend into the RF cavity 110 in some cases and/or even be in contact with the back plane 152 of the electron source 150.

Desirably, the light guides are oriented such that they propagate the desired radiation from an exterior light or photon source 170 (such as a laser source (e.g., a UV or EUV laser source) or soft X-ray source) to the back plane 152 of the nanotubes (e.g., platinum coated carbon nanotubes) forming the back plane 152. The nanotubes can be configured such that the chirality (e.g., the rotational arrangement of the atomic structure) is such that the nanotubes are highly conductive and electrons travel ballistically through the tubes at, for example, ~1/10 light speed. Other chiralities can also be used such that the nanotubes are semi-conducting or even exhibit poor conductivity.

In certain example implementations, the nanotubes can be coated with platinum such that the platinum forms a solid surface at the backplane for a few angstroms and then slowly transitions from the solid surface to a partially coated and then to a relatively pristine, uncoated nanotube structure at the surface opposite the back plane. This can happen, for instance, over a thickness range of 3-8 microns, depending on the application. These relatively pristine (uncoated) nanotubes at the surface opposite the back plane then form the nucleation sites for the initiation and growth of the diamond structure. During the diamond growth process, and in accordance with certain embodiments of the disclosed technology, the device temperature is raised to above 500 C°, and through catalysis, a platinum carbide is formed at the platinum/carbon nanotube interface where the conductivity increases by, for example, a factor of approximately 10. This results in a desirable probability density for electron tunneling from the metal contact (Pt) into the nanotube/diamond matrix.

Figure 2A:
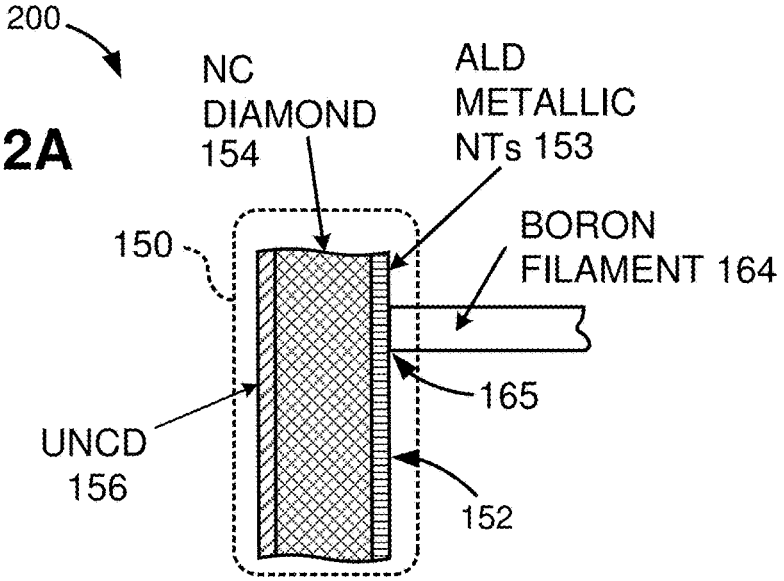
FIG. 2A is a cross-section of an example interface between an end of a respective one of the boron filaments and the back plane of an electron source in accordance with an embodiment of the disclosed technology.
Figure 2B:
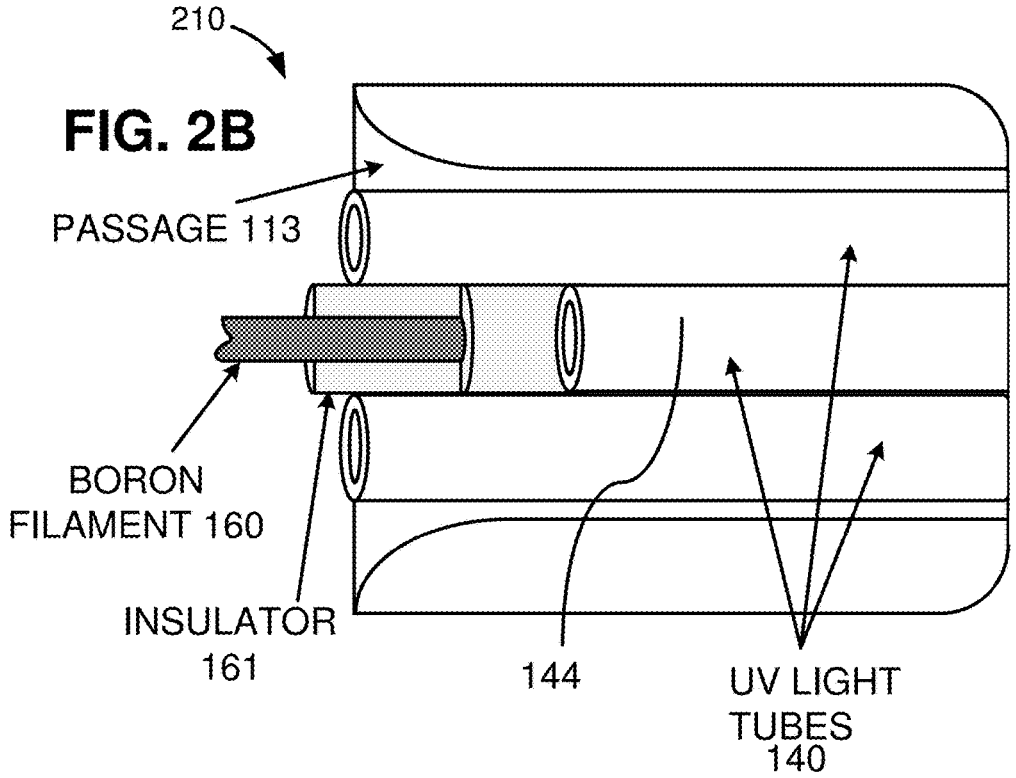
FIG. 2B shows an example set of UV light tubes surrounding a boron filament in accordance with an embodiment of the disclosed technology.

FIG. 2A is a cross-sectional view 200 illustrating the section labeled "A" in FIG. 1. In particular, FIG. 2A shows the interface between an end 165 of a respective one of the boron filaments (here, boron filament 164) and the electron source 150. In the illustrated embodiment, the back plane 152 is formed of atomic layer deposited (ALD) carbon nanotubes 153. The carbon nanotubes 153 can include a platinum layer, such as the platinum coat as described above. FIG. 2A also shows a nanocrystalline diamond 154 adjacent to the carbon nanotubes 153. The nanocrystalline diamond 154 of the illustrated embodiment further includes an ultrananocrystalline layer 156 at its front side opposite of the back plane 152. The ultrananocrystalline (UNCFD) layer 156 is the surface layer of the electron source 150 where electron emission occurs (e.g., the layer where degenerate electrons are quantum confined). The nanocrystalline diamond/carbon nanotube structure shown in FIG. 2A can be formed using any of a variety of methods. For example, any of the example methods discussed in U.S. Pat. No. 8,227,985 or described above can be used to generate the nanotubes 153 and/or the nanocrystalline diamond 154.

In FIG. 2A, the boron filament 164 has an end 165 affixed to the back plane 152. The end 165 of the boron filament 164 can be affixed to the back plane 152 using a variety of methods. For instance, in certain embodiments, atomic layer deposition techniques are used to connect the boron filament(s) to the back plane 152. In other embodiments, physical vapor deposition is used to create a mechanical interface between the boron filament 164 and the back plane 152. When physical vapor deposition is used, it is desirably used only at the point of contact so that phototransparency is retained in the other locations of the nanotubes.

Boron is well suited to serve as the support structure for the electron source 150, but filaments (or other support structures) made from different materials can also be used to suspend the electron source 150 within the RF cavity in accordance with embodiments of the disclosed technology. In general, the material used for the support structure is relatively stiff such that it can reliably suspend the electron source (e.g., of 1-100 grams) at a distance from the cavity back wall. Additionally, in certain implementations, the material used for the support structure exhibits variable semiconductivity (e.g., boron, carbon, carbon composites, or other such semiconductive materials having a suitable stiffness). This property allows the support structure (support filaments) to not only provide mechanical support, but to also allow the structure to be used to balance the electron charge in the electron source (e.g., by acting as a ground reference for the electron source). For instance, the semiconductive tunability of the boron filaments can be used to help replenish electrons in the electron source by selectively varying the semiconductivity of the boron filaments used to fabricate the support structure for the electron source (and to potentially provide electrons from an external source to the electron source, as needed).

FIG. 2B is a cross-sectional view 210 illustrating the section labeled "B" in FIG. 1. In particular, FIG. 2B shows an example set 140 of UV light tubes surrounding a boron filament as the UV light tubes and boron filament pass through a passage 113 of the LHe shell 112. In the illustrated embodiment, four light tubes surround a respective boron filament (here, boron filament 160) in a diamond-shaped pattern. In FIG. 2B, three light guides are visible with the fourth being located behind a foremost light guide (light guide 144) and the boron filament 160. Also, to reveal the boron filament 160, the foremost light guide 144 is shown as being partially cut away. Further, in the illustrated embodiment, the boron filament 160 is surrounded by an insulative exterior sleeve 161 (or sheath), which is shown as partially cut away in FIG. 2B to reveal the interior boron filament 160. The boron filament 160 can be fabricated using a variety of techniques. In one example embodiment, the boron filament 160 is fabricated from a tungsten wire surrounded by boron and subjected to an extrusion process. The insulative exterior sleeve 161 can be fabricated from a variety of materials. For instance, the insulator material can be Kapton (polyamide), Teflon (PTFE), or even exhibit some of the semiconducting properties of the filaments, like doped carbon composite electrically terminated in a ambient temperature device in the room environment. The particular selection of the material for the insulative exterior sleeve 161 will typically depend on the application, since the filaments to some extent are RF antennas and, as such, are part of the overall electronic design, although the cavity design will typically reduce (minimize) the RF power on the back side of the electron emitter.

The electronic properties, robust nature, and thermal stability of embodiments of the disclosed technology make it possible to fabricate a partially electrically transparent photo-gated electron emitter weighing only several grams for a typical application. The resonant quantum electronic structure of such embodiments also provides efficient UV or soft x-ray photon scattering through the nanocrystalline diamond structure to provide uniform photo-gating at the emitter surface.

Figure 3:
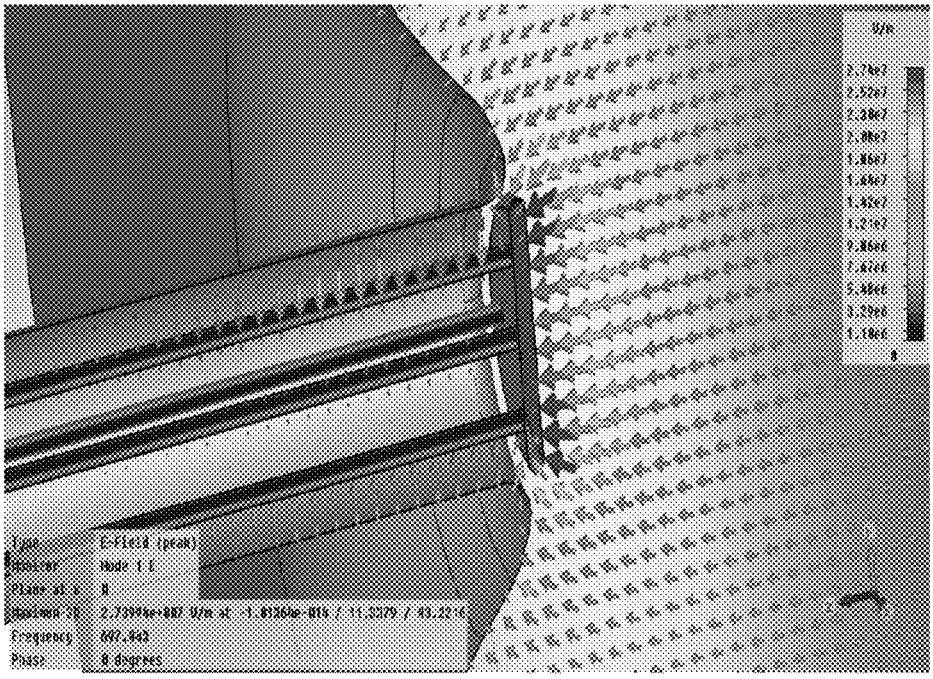
FIG. 3 is a diagram showing the electric field lines for an electron source in accordance with an embodiment of the disclosed technology.

FIG. 3, for example, is a schematic diagram illustrating the electrical field associated with such an electron source in an RF cavity during a possible electron emission period in accordance with an embodiment of the disclosed technology. The photon transport through the crystalline diamond and doping defect interaction create the free charge within the bulk structure as well as a high, near surface charge density for the Coulomb interactive charge gating process.

The electron source quantum electrodynamic functionality of the disclosed technology can be described as the creation of surface plasmons at diamond defect sites, where the free charge polaritons probabilistically evolve to excitons at indeterminate locations within the diamond bulk material. The near surface emission region is created through materials design and can depend on the intended application. One configuration is the n-type diamond near surface layer that is gated by Coulomb processes. Another surface design is a dense layer of ultrananocrystalline (UNC) with crystallites (e.g., 3-5 nm crystallites) creating quantum confined degenerate electron charge at a high population density. This UNC layer can be doped with interstitial nitrogen atoms. In such cases, photo excitation of the nitrogen defects gates the trapped charge in the individual crystallites, allowing pulse extraction in the RF electric field. Other charge gating methods may also be employed due to the wide number variations able to be created within the diamond structure.

Among the features that can be realized in embodiments of the disclosed technology is the suspension (or immersion) of the electron source in the high power RF field of the cavity. The suspension provides thermal isolation and also adds the capability for replenishment of the gated beam charge. This is accomplished through "energy harvesting" of the large amount of free charge trapped in the various non-accelerating RF modes within a typical RF injector cavity. These modes, in combination with secondary electron emission from the cavity structure, create a significant amount of mode trapped electron charge at the cavity accelerating-decelerating sine wave energy. A significant fraction of the back-accelerated electrons that impinge on the diamond emitter have sufficient energy to penetrate the device facilitating the charge neutralization of any vacancies within the device that may remain following the pulse extraction. The semi-conducting boron filaments supporting device also act as a neutralizing balance, ensuring the device is electrically neutral prior to the next pulse extraction. The effects, interactions, and dynamical electron emission phenomena from a diamond device in high frequency RF fields thus form a highly desirable accelerator source.

Embodiments of the disclosed technology can be used in a variety of applications. For instance, the disclosed technology can be used as part of an x-ray free electron laser (XFEL) system. In such free electron laser systems, the lasing medium is typically the electron beam as it passes through a wiggler, amplifying light either present in the wiggler (cavity) through spontaneous emission or as laser seeded injection. The coherence of the amplified beam is directly dependent on the quality of the electron beam, while the light frequency (wavelength) is dependent on the wiggler period and beam energy. In megawatt power directed energy FELs, the beam coherence determines the energy density on the target in the far field many tens of kilometers from the source. To create the necessary beam quality with a very high bunch charge (IR-FEL) from a small emitter area source, embodiments of the disclosed technology can be used.

Among the features that can be realized in embodiments of the disclosed technology is high current density capability. Other features include that the electrons are "born" in the crystalline surface structure of the field transparent device. The extracted electrons emanate from the various very low energy states at the conduction band minimum and are accelerated through the negative electron affinity surface to the vacuum level with no step up in energy and no other interactions due to surface state phenomena. This creates a very "cold" (less than 0.01 eV) electron bunch, resulting in a very high quality (low emittance) composite beam structure as required by the low bunch charge used in XFEL systems.

III. Concluding Remarks

Having illustrated and described the principles of the disclosed technology, it will be apparent to those skilled in the art that the disclosed embodiments can be modified in arrangement and detail without departing from such principles. For example, any one or more aspects of the disclosed technology can be applied in other embodiments. In view of the many possible embodiments to which the principles of the disclosed technologies can be applied, it should be recognized that the illustrated embodiments are only preferred examples of the technology and should not be taken as limiting the scope of the invention.

What is claimed is:

1. An electron injection system for a superconducting radiofrequency (SRF) accelerator system, comprising:
- a liquid-cooled vessel defining a radio frequency (RF) cavity in which an electron source is located;
- an electron source located within the RF cavity, but not in direct contact with any surface of the RF cavity;
- one or more support structures that extend from a back wall of the RF cavity and mechanically connect with a back plane of the electron source; and
- one or more light guides surrounding respective ones of the support structures, the one or more light guides also extending from the back wall of the RF cavity.

2. The system of claim 1, wherein the electron source is suspended within the RF cavity such that a back plane of the electron source does not make any direct contact with a back wall of the RF cavity.

3. The system of claim 1, wherein the support structures comprise one or more boron filaments.

4. The system of claim 1, wherein the support structures comprise one or more filaments having variable semiconductivity.

5. An electron injection system for a superconducting radiofrequency (SRF) accelerator system, comprising:
- a liquid-cooled vessel defining a radio frequency (RF) cavity in which an electron source is located;
- an electron source located within the RF cavity, but not in direct contact with any surface of the RF cavity; and
- one or more light guides configured to transmit photons from a photon source external the RF cavity to a back plane of the electron source, thus causing electron emission from the electron source.

6. The system of claim 5, wherein the photon source is a UV laser source or a soft x-ray source.

7. The system of claim 5, wherein the photon source is further configured to transmit photons through the light guides at a time during which a periodic electric field in the RF cavity causes electron beam emission from a front surface of the electron source opposite of the back plane of the electron source.

8. An electron injection system for a superconducting radiofrequency (SRF) accelerator system, comprising:
- a liquid-cooled vessel defining a radio frequency (RF) cavity in which an electron source is located; and
- an electron source located within the RF cavity, but not in direct contact with any surface of the RF cavity,
- wherein the electron source comprises a diamond structure or a diamond QED based electron source.

9. The system of claim 8, wherein the electron source is a diamond QED based electron source that further comprises:
- a carbon nanotube structure adjacent to which a diamond structure is located; and
- a platinum coating at an end of the carbon nanotube structure.

10. The system of claim 1, wherein the liquid-cooled vessel contains a volume of liquid helium.

11. A method, comprising:

suspending an electron source within an injector cavity of a superconducting radiofrequency (SRF) accelerator system such that the electron source is located within an RF cavity, but not in direct contact with any surface of the RF cavity; and selectively transmitting photons to a back plane of the electron source at times synchronized with the periodic RF field generated in the RF cavity, the photons being generated from a light source external to the RF cavity, wherein the selectively transmitting photons is performed by transmitting photons toward the back plane of the electron source through one or more light guides that have respective transmission ends that are located at the back wall of the RF cavity or extend into the RF cavity.

12. The method of claim 11, wherein the suspending is performed by one or more support structures having selective semiconductivity and wherein the method comprises selectively adjusting the semiconductivity of the support structure in order to alter the electronic replenishment within the RF cavity.

13. A system, comprising:

a superconducting radiofrequency (SRF) accelerator system, comprising:

a liquid-cooled vessel defining a radio frequency (RF) cavity in which an electron source is located; and a photon-activated electron source located within the RF cavity, the photon-activated electron source being suspended in an interior of the RF cavity distal from an end wall of the RF cavity, wherein the photon-activated electron source is suspended within the RF cavity by one or more support structures comprising one or more filaments having variable semiconductivity.

14. The system of claim 13, wherein the electron source comprises a diamond QED based electron source.

* * * * *